US012364914B2

(12) United States Patent
Ventarola

(10) Patent No.: US 12,364,914 B2
(45) Date of Patent: Jul. 22, 2025

(54) THROWING TRAINING DEVICES AND METHODS OF USE

(71) Applicant: Alexis Ventarola, Scarsdale, NY (US)

(72) Inventor: Alexis Ventarola, Scarsdale, NY (US)

( * ) Notice: Subject to any disclaimer, the term of this patent is extended or adjusted under 35 U.S.C. 154(b) by 233 days.

(21) Appl. No.: 17/988,871

(22) Filed: Nov. 17, 2022

(65) Prior Publication Data

US 2023/0158386 A1 May 25, 2023

Related U.S. Application Data

(60) Provisional application No. 63/281,664, filed on Nov. 20, 2021.

(51) Int. Cl.
*A63B 69/00* (2006.01)

(52) U.S. Cl.
CPC ..... *A63B 69/0002* (2013.01); *A63B 69/0059* (2013.01); *A63B 2069/0006* (2013.01)

(58) Field of Classification Search
CPC ..... A63B 69/0002; A63B 69/0059; A63B 2069/0006; A63B 2225/09; A63B 2071/0694; A63B 2209/10; A63B 2210/50; A63B 2214/00
USPC ..... 473/214, 409, 447, 488, 450
See application file for complete search history.

(56) References Cited

U.S. PATENT DOCUMENTS

| | | | | |
|---|---|---|---|---|
| 3,820,783 | A * | 6/1974 | Caveness | A63B 69/0071 273/DIG. 19 |
| 4,984,789 | A * | 1/1991 | Socci | A63B 69/0002 473/458 |
| 5,375,836 | A * | 12/1994 | Kiser | A63B 69/0059 473/458 |
| 5,769,743 | A * | 6/1998 | Stephan | A63B 69/0059 473/214 |
| 5,865,695 | A * | 2/1999 | Mahala | A63B 69/0071 473/450 |
| 6,789,344 | B2 * | 9/2004 | Cain | F41C 33/001 224/265 |
| 8,152,660 | B1 * | 4/2012 | Jimenez, Jr. | A63B 69/0071 473/422 |
| 2004/0179891 | A1 * | 9/2004 | Watkins | F16C 11/10 403/96 |

* cited by examiner

*Primary Examiner* — Nini F Legesse
(74) *Attorney, Agent, or Firm* — Michael J Porco; Gerald E Hespos

(57) ABSTRACT

Throwing or pitching training devices and methods of use are provided. The training devices include a first linear member coupled to a second linear member at a predetermined angle by an elbow member; the second linear member including at least two securing members that secures the second member to a user such that the second linear member is parallel to a torso of the user and the first linear member is parallel to a plane formed by the shoulders of the user, wherein the first linear member provides tactile feedback to the user upon the user attempting a throwing motion.

19 Claims, 16 Drawing Sheets

THROWING TRAINING DEVICES AND METHODS OF USE

PRIORITY

This application claims priority to U.S. Provisional Patent Application Ser. No. 63/281,664, filed Nov. 20, 2021, entitled "THROWING TRAINING DEVICES AND METHODS OF USE", the contents of which are hereby incorporated by reference in its entirety.

FIELD

The present disclosure generally relates to sporting equipment and sport training devices, and more particularly, to throwing or pitching training devices and methods of use.

BACKGROUND

For years, parents have tried to find ways to help their kids who play baseball or softball to throw properly. When young athletes throw a baseball or softball, there is a tendency for the athlete to drop their elbow and push the ball. These bad habits can be detrimental to an athletes' development. As they get older and can produce more force, the athletes can sustain injuries to the shoulder and elbow which in turn can end an athlete's career.

Proper throwing mechanics are crucial not only for performance of the athlete but also the health of the athlete. When throwing properly, the elbow should be in-line with the shoulder plane. FIG. 1 illustrates various degrees of arm abduction, also known as shoulder abduction. When throwing properly, the elbow should be in-line with the shoulder plane, which would bring the arm up to 90° of abduction. FIG. 2 illustrates a baseball player 10 throwing a baseball with proper form, i.e., 90 degree shoulder abduction. As can be seen in FIG. 2, an elbow 12 of the player 10 is in-line with the player's shoulder 14, or shoulder plane 16, resulting in a shoulder abduction of 90 degrees.

Anything lower than 90° abduction will result in the athlete 10 pushing the ball. Referring to FIG. 3, the player's elbow 12 is below the shoulder plane 16 resulting in a shoulder abduction of angle X, e.g., about 60 to about 30 degrees. A player 10 employing the pitching form shown in FIG. 3 will tend to push the ball, thereby placing undue stress on the player's elbow 12.

Therefore, a need exists for techniques for teaching and/or training an individual to properly throw a ball.

SUMMARY

The present disclosure is directed to throwing training devices and methods of use.

According one aspect of the present disclosure, a throwing training device is provided. The throwing training device includes an "L" shaped implement that uses straps or other means to keep the throwing training device against the body of a user. A corner of the "L" shaped implement is to be placed in the armpit of the user, where an upper strap goes up and over the opposite side shoulder of the user and a lower strap go all the way around the torso.

In one aspect, the L-shaped implement in configured from a first linear member coupled to a second linear member by an elbow.

In another aspect, at least one of the first or second linear members include at least two slits for receiving the straps.

In a further aspect, the L-shaped implement and/or the first and second linear members may be covered with a flexible covering, such as polyethylene foam, to provide comfort to the user when wearing the throwing training device.

In yet another aspect, at least one of the first or second linear members is configured with a concave surface, where the concave surface is configured to conform to a circular portion of the individual's torso, i.e., the individual's side.

In another aspect, the first and second linear members are coupled together by a pivoting joint that enables the first and second linear members to be positioned at different angles relative to each other.

According to another aspect of the present disclosure, a method for training a user to properly throw a ball is provided. The method includes providing an L-shaped implement, coupling the implement to a user by placing a corner of the L-shaped implement under an armpit of the user and securing the implement to a torso of the user via at least two straps, instructing the user to initiate a throwing motion and providing tactile feedback of an improper throwing motion if an elbow of the user hits or makes contact with the implement.

It is to be appreciated that the throwing training device of the present disclosure may be employed for training a user in proper throwing techniques for any type of object, for example, a baseball, softball, football, etc.

BRIEF DESCRIPTION OF THE DRAWINGS

The above and other aspects, features, and advantages of the present disclosure will become more apparent in light of the following detailed description when taken in conjunction with the accompanying drawings in which.

Figure 1:
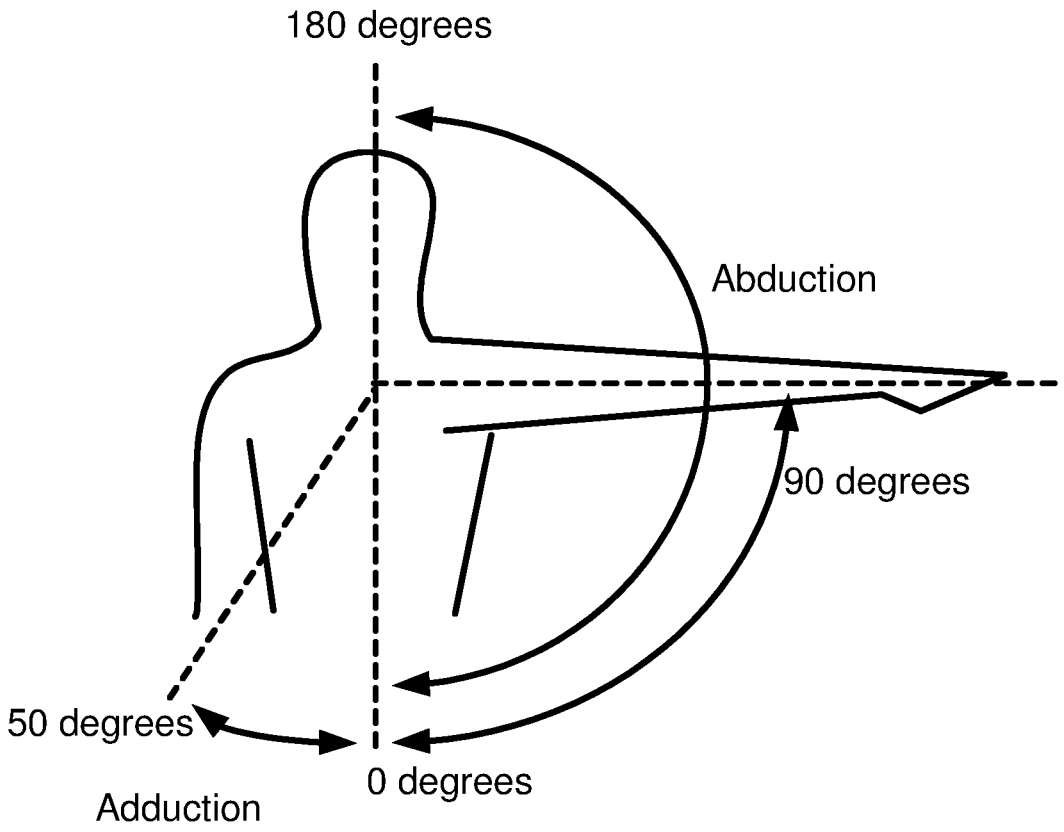
FIG. 1 illustrates abduction of a shoulder of an individual.
Figure 2:
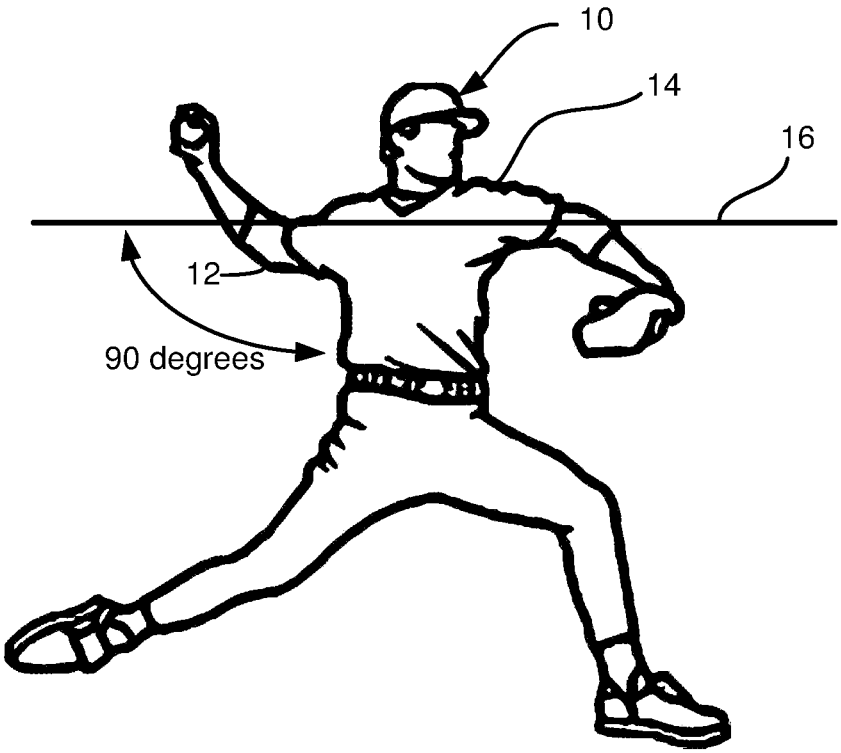
FIG. 2 illustrates an individual throwing a baseball with proper shoulder abduction.
Figure 3:
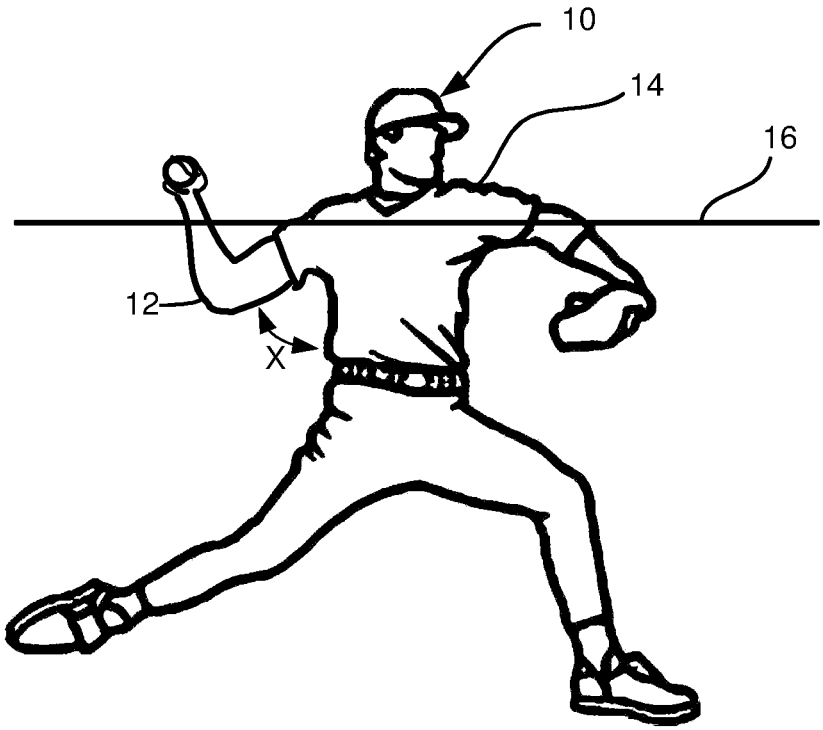
FIG. 3 illustrates an individual throwing a baseball with improper shoulder abduction.

It should be understood that the drawing(s) are for purposes of illustrating the concepts of the disclosure and is not necessarily the only possible configuration for illustrating the disclosure.

DETAILED DESCRIPTION

Embodiments of the present disclosure will be described herein below with reference to the accompanying drawings. In the following description, well-known functions or constructions are not described in detail to avoid obscuring the present disclosure in unnecessary detail. The word "exemplary" is used herein to mean "serving as an example, instance, or illustration." Any configuration or design described herein as "exemplary" is not necessarily to be construed as preferred or advantageous over other configurations or designs. Herein, the phrase "coupled" is defined to mean directly connected to or indirectly connected with through one or more intermediate components.

The present disclosure is directed to throwing training device and method of use. The throwing training device is an "L" shaped implement that uses straps or other means to keep the device against the body of a user. A corner of the "L" shaped device is to be placed in the armpit of the user. A top strap goes up and over the opposite side shoulder of the user; the strap should be snug so the implement does not move. The other lower strap should go all the way around the torso. This too should be snug. An upper portion of implement will be inline with both shoulders. The implement preferably should be at least ⅓ down the upper arm of the athlete and at least % down the rib cage to work properly. The straps are adjustable so the implement can fit snugly against the body and not move.

Figure 4:
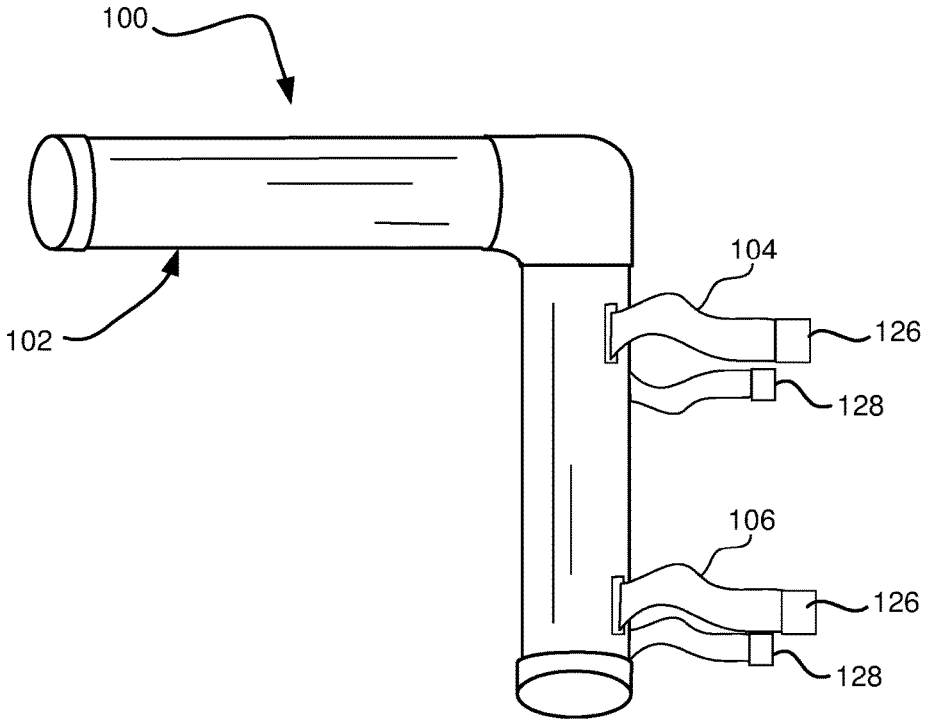
FIG. 4 illustrates a throwing training device in accordance with an embodiment of the present disclosure.

Referring to FIG. 4, a throwing training device 100 is provided in accordance with the present disclosure. The pitching training device 100 includes an "L"-shaped member 102 that is positioned on a torso of a user and at least two securing means 104, 106, e.g., straps, for securing the member 102 to the torso of the user. In one embodiment, the member 102 is configured from a single piece of material that is formed in an L shape, for example, plastic, resin, a composite material, wood, foam, rubber, etc.

Figure 5:
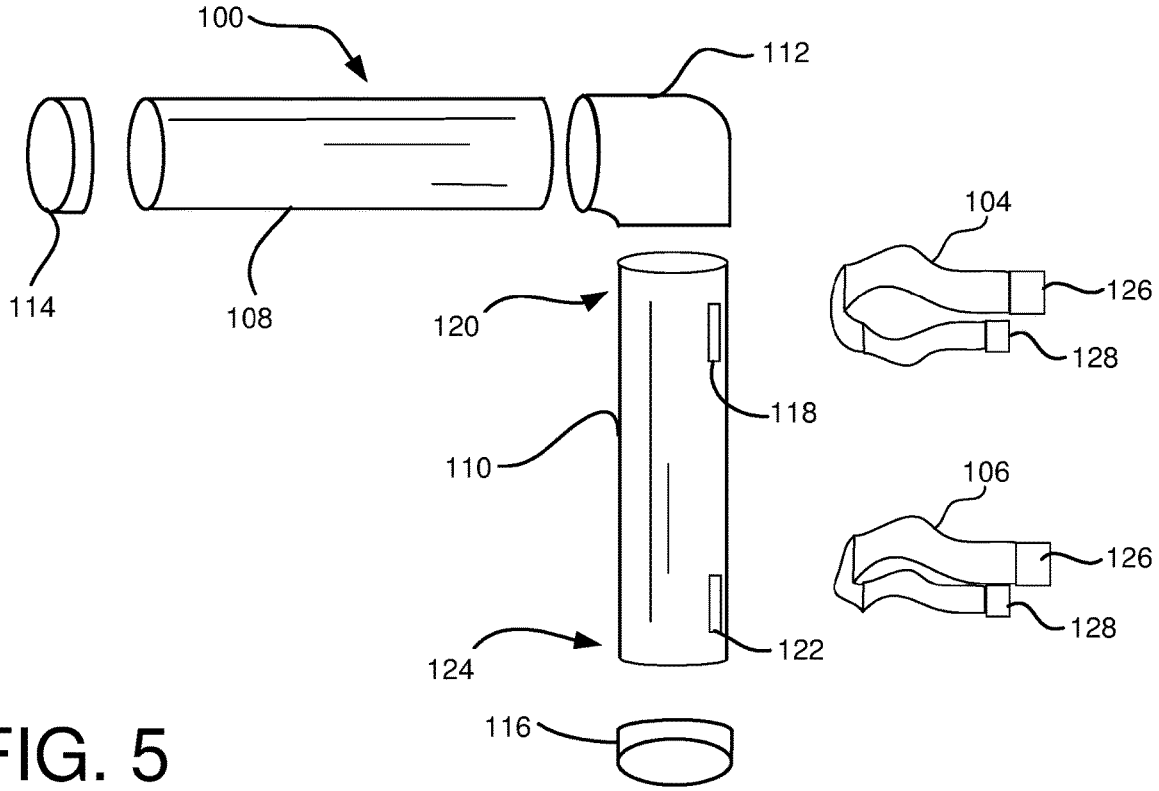
FIG. 5 is an exploded view of the throwing training device shown in FIG. 4.

In other embodiment, member 102 is configured from several parts as shown in FIG. 5. Referring to FIG. 5, member 102 includes a first linear member 108 joined to a second linear member 110 via an elbow 112. Optionally, a free end of member 108 is covered by an end cap 114 and a free end of member 110 is covered by an end cap 116. A first pair of corresponding slits 118 are disposed on a first end 120 of member 110. It is to be appreciated that only one of the slits 118 is shown in FIG. 5 and the corresponding slit is on a rear side of member 110 to allow the securing member, e.g., a strap, to pass through. Slits 118 are configured to receive strap 104 and to secure first end 120 of member 110 to a torso of a user. Similarly, a second pair of corresponding slits 122 are disposed on a second end 124 of member 110. It is to be appreciated that only one of the slits 122 is shown in FIG. 5 and the corresponding slit is on a rear side of member 110 to allow the securing member, e.g., a strap, to pass through. Slits 122 are configured to receive strap 106 and to secure second end 124 of member 110 to a torso of a user.

The ends of straps 104, 106 may include fasteners for coupling the ends of the straps to each other when securing the device 100 to a torso of a user. In one embodiment, the fastener may be a quick release buckle including an engagement part 126 and a receptor part 128. In another embodiment, one end of the strap 104, 106 may include a belt-type buckle while the other end of the strap 104, 106 includes a plurality of holes/apertures to receive a prong of the belt-type buckle. The present disclosure contemplates any type of fastener that couples two ends of straps to be within the scope of the present disclosure, for example, hook and loop fasteners, a rivet and snap fastener, etc.

In one embodiment, member 102 is configured from PVC pipes, where linear members 108, 110 are configured from ½ inch PVC pipes with two ½ inch PVC end caps, e.g., end caps 114, 116, and one ½ inch PVC elbow, e.g., elbow 112. Member 110 includes four 1 inch slits, two slits, e.g., slits 118, are ½ inch away from the top end 120 of the PVC member 110 and two slits, e.g., slits 122, are ½ inch away from the bottom end 124 of the PVC member 110. Each slit of the pairs of slits are on direct opposite sides of the PVC member 110 so you can see straight through, i.e., to allow a securing member to pass through the linear member 110.

It is to be appreciated that PVC pipes are one exemplary material that may be employed to configure members 102, 108, 110 and that other materials are contemplated to be within the scope of the present disclosure.

Figure 6A:
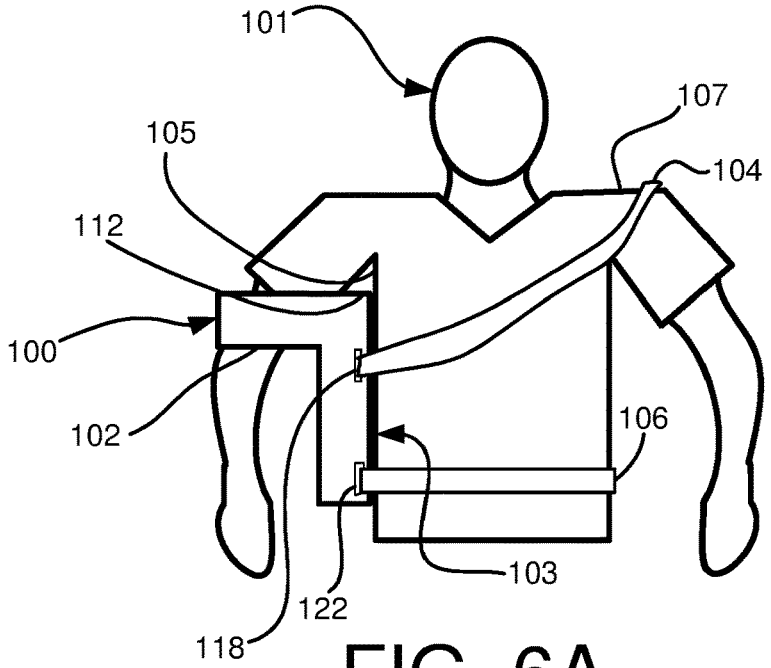
FIG. 6A illustrates a throwing training device attached to an individual in accordance with an embodiment of the present disclosure.

Referring to FIG. 6A, the throwing training device 100 of the present disclosure is attached to an individual 101. Member 102 of device 100 is placed along the torso 103 of the individual such that the elbow 112 is positioned below an armpit 105 of the individual 101. Member 102 is then secured to the individual's torso 103 by arranging strap 104 through slits 118 and then over an opposite shoulder 107 of the individual 101. Similarly, strap 106 is arranged through slits 122 and then around the individual's torso 103.

Figure 6B:
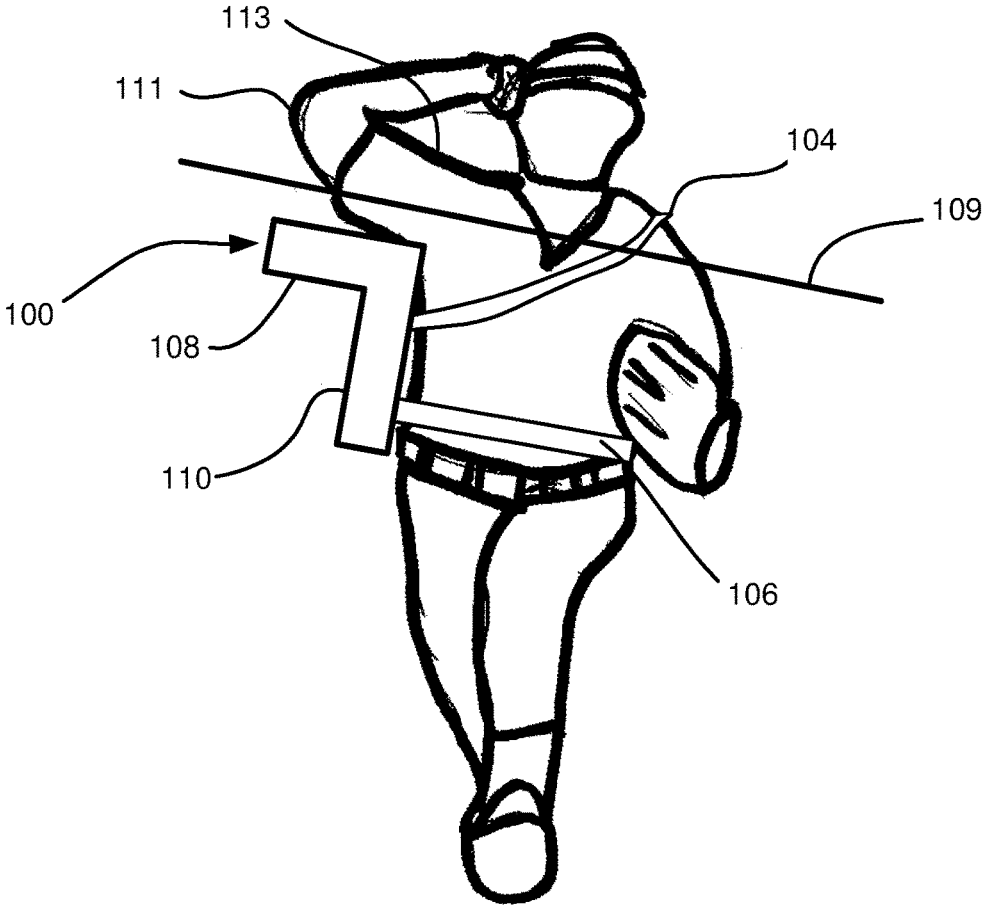
FIG. 6B illustrates an individual throwing a baseball employing the throwing training device of the present disclosure.

Referring to FIG. 6B, an individual employing the device 100 is illustrated showing proper throwing or pitching form. As shown in FIG. 6B, the individual's elbow 111 and upper arm 113 are in-line with the individual's shoulder plane 109, i.e., 90° of shoulder abduction. Initially, the individual will start in what is known as the flip up position, where the individual is holding the ball behind the individual's heads with the individual's arm bent at approximately 90 degrees and the individual's upper arm in line with a plane of the individual's shoulders. The individual will begin to clear their front side as their throwing arm goes into layback (maximum external rotation of the shoulder), through the arm path (over the device 100) to ball release.

If the athlete does not get up to 90° of shoulder abduction, then the individual's elbow 111 and/or upper arm 113 will hit or make contact with the training device 100, for example, may make contact with linear member 108. This is immediate tactile feedback, letting the athlete know that they are dropping their elbow 111. If the athlete does not hit the implement, then the athlete knows they kept their elbow at, at least 90° of shoulder abduction. This allows the athlete to work on their own without a parent or coach directly watching them and telling them they are dropping their elbow or not. Also, coaches are not able to watch every single one of their athletes at the same time. The throwing training device 100 of the present disclosure will make the coach's job easier because of the immediate feedback it gives the athlete.

It is to be appreciated that although the above embodiments describe training a user in the throwing motion of a baseball, the techniques and devices of the present disclosure may be employed to teaching or training proper throwing form for various objects such as a softball, football, etc.

Figure 7:
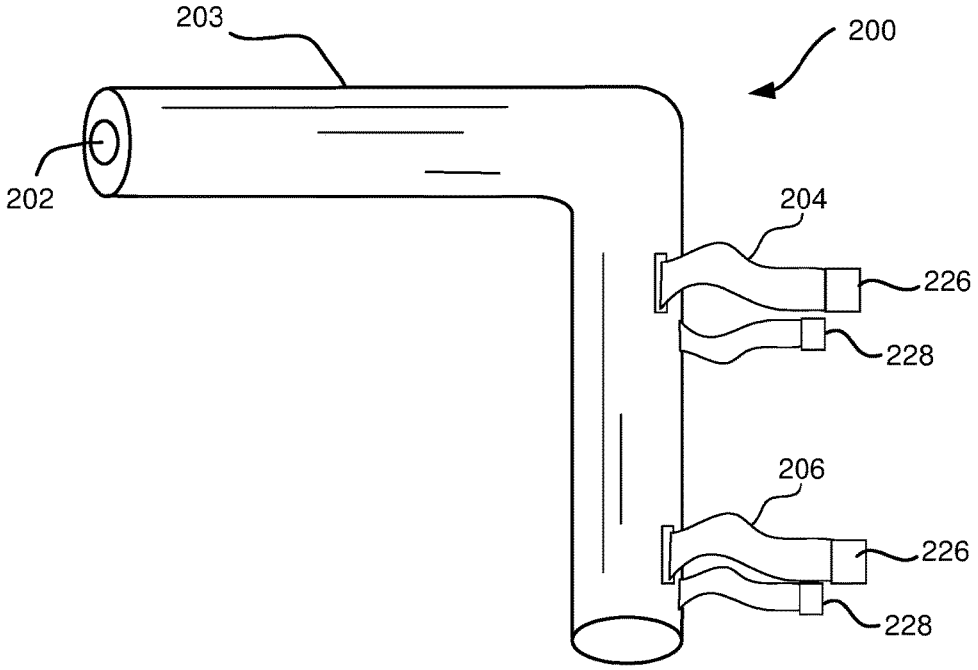
FIG. 7 illustrates a throwing training device in accordance with a second embodiment of the present disclosure.

Referring to FIG. 7, a throwing training device 200 in accordance with another embodiment of the present disclosure is provided. Device 200 is configured in a similar manner to device 100 described above. However, in this embodiment, device 200 includes a flexible covering 203 which covers L-shaped member 202. It is to be appreciated that L-shaped member 202 is configured similar to member 102 and/or the combination of linear members 108, 110 and elbow 112. The covering 203 is provided for comfort when member 202 comes into contact with the individual torso. The covering 203 may be configured from various materials including polyethylene foam, Styrofoam, etc. It is to be appreciated that the covering 203 may be configured as a single unitary piece or may include at least two pieces where a first portion of covering is disposed over member 108 and a second portion of covering is disposed over member 110.

It is further to be appreciated that device 200 includes securing members 204, 206, e.g., straps, as described above. The ends of straps 204, 206 may include fasteners for coupling the ends of the straps to each other when securing the device 200 to a torso of a user. In one embodiment, the fastener may be a quick release buckle including an engagement part 226 and a receptor part 228. In another embodiment, one end of the strap 204, 206 may include a belt-type buckle while the other end of the strap 204, 206 includes a plurality of holes of receive a prong of the belt-type buckle. The present disclosure contemplates any type of fastener that couples two ends of straps to be within the scope of the present disclosure, for example, hook and loop fasteners, a rivet and snap fastener, etc.

Figure 8A:
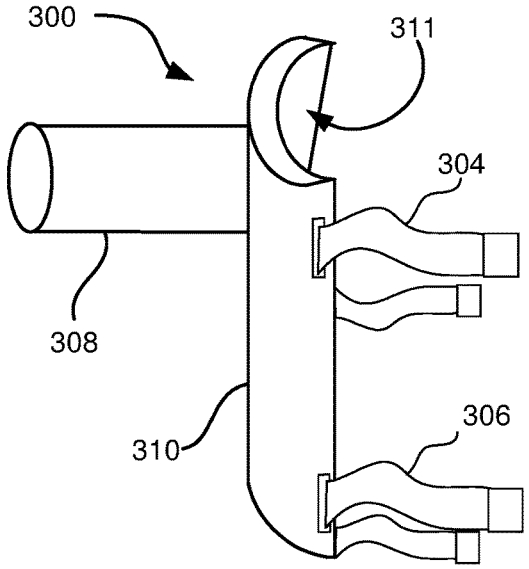
FIGS. 8A and 8B illustrate a throwing training device in accordance with a third embodiment of the present disclosure.
Figure 8B:
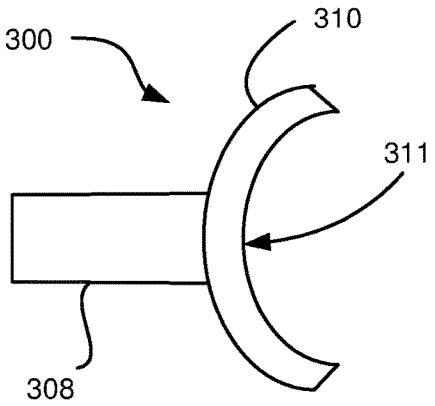

Referring to FIG. 8, a throwing training device 300 in accordance with another embodiment of the present disclosure is provided. Device 300 is configured in a similar manner to device 100 described above. However, in this embodiment, device 300 includes a first linear member 308 configured at a right angle to a linear second member 310, which is configured with a concave surface 311. The concave surface 311 of member 310 is configured to conform to a circular portion of the individual's torso, i.e., the individual's side, when coupling the device 300 to the user via the securing members 304, 306. In the is manner, the device 300 is more stable and less prone to turning when disposed on the torso.

In one embodiment, member 102 may include a flexible or adjustable portion such that members 108 and 110 may be set at angles other than 90 degrees relative to each other. For example, the elbow 112 may be made from a flexible yet rigid material such that member 108 may be set at a predetermined angle relative to member 110 and, once set or positioned, the members 108, 110 will remain in the predetermined angle, i.e. the predetermined angle is adjustable. One exemplary flexible yet rigid material is FostaPEX multi-layered tubing commercially available from Viega LLC of Broomfield, CO The multi-layered tubing includes at least one layer of polyethylene and aluminum to enable the tubing to be manipulated and retain its shape after manipulation.

Figure 9A:
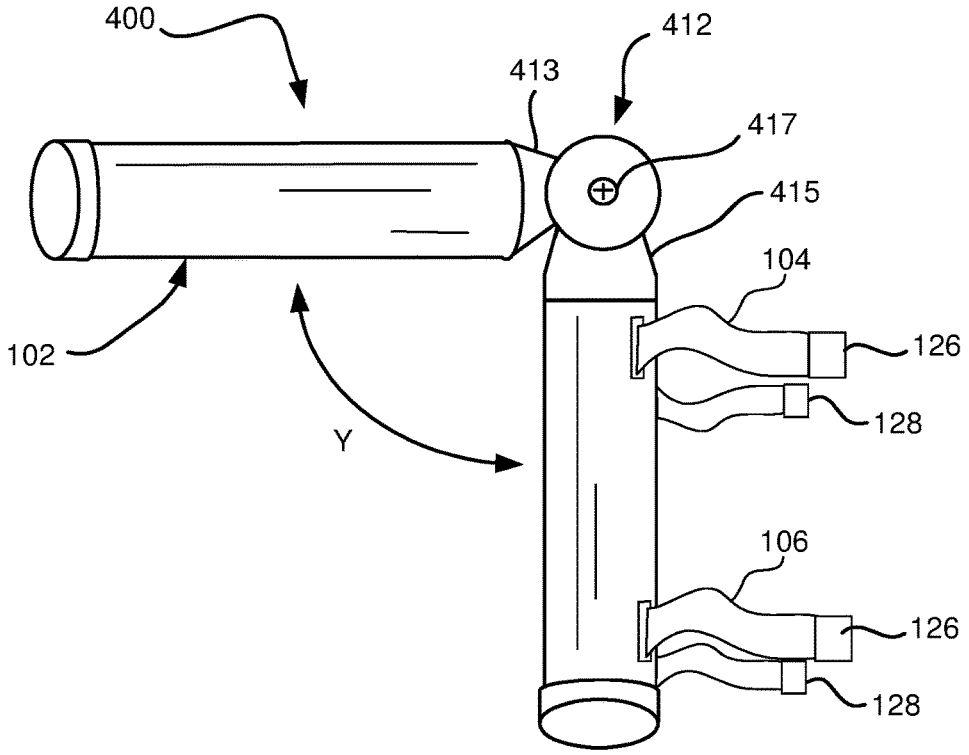
FIGS. 9A and 9B illustrate a throwing training device in accordance with a fourth embodiment of the present disclosure.
Figure 9B:
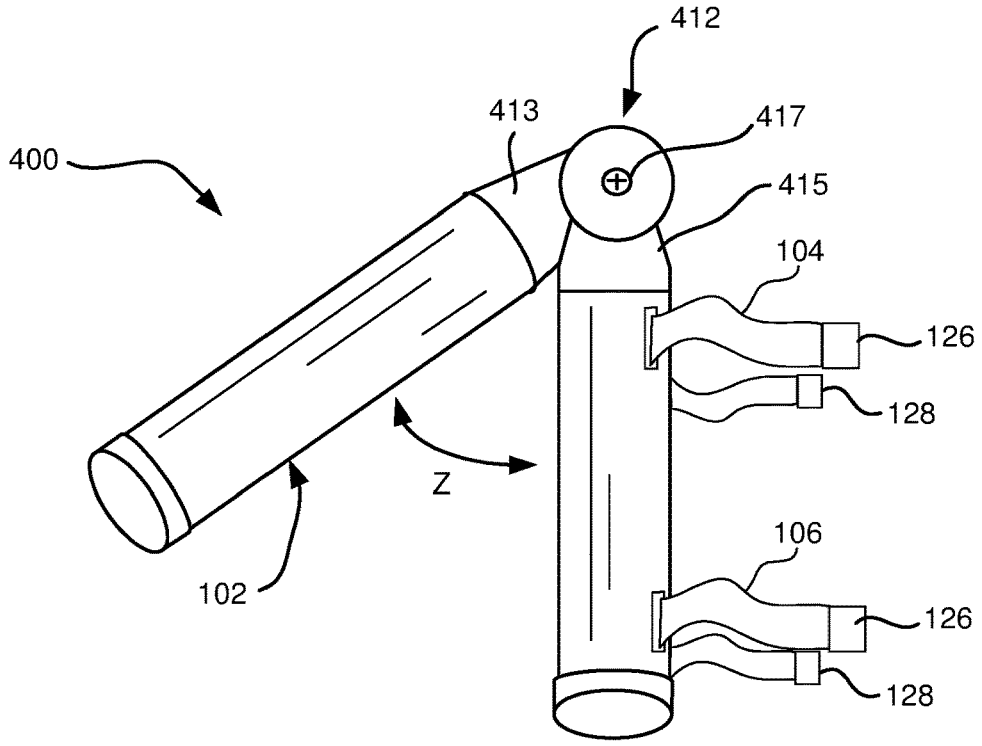

In another embodiment, the elbow 112 may be a pivoting joint 412 as shown in the device 400 of FIGS. 9A-9B, where the joint 412 is configured from two arms 413, 415 that are coupled together by a bolt 417. Each of the arms 413, 417 includes ridges on the mated surfaces of the arms which allow for an immovable joint 412 once the bolt 417 is tightened, as shown in FIG. 9A locked at angle Y. Conversely, once the bolt 417 is loosened, the arms 413, 415 may be adjusted to varying degrees, for example, angle Z shown in FIG. 9B. In this manner, the angle between the members 108 and 110 can be adjusted and not always at just a 90 degree angle. This flexibility will enable the throwing device 400 to be adjustable for a particular user. Additionally, the members 108 and 110 may be positioned upon each other, i.e., a zero degree angle relative to each other, to facilitate storage and portability of the device 100.

Referring to FIGS. 10A-10E, a throwing training device 500 in accordance with another embodiment of the present disclosure is provided. Similar to the embodiments described above, device 500 includes a first linear member 508 and a second linear member 510 joined by elbow 512. In this embodiment, a first pillow or covering 552 is disposed over first member 508 and a second pillow or covering 555 is disposed over second member 510. The pillows or coverings 552, 554 are provided for comfort when device 500 comes into contact with the individual torso. The coverings 552, 554 may be configured from various materials including polyethylene foam, Styrofoam, etc. The coverings 552, 554 are generally cylindrical with a closed end 556, 558 respectively. The coverings 552, 554 include a channel to receive the respective member 508, 510 where the closed ends 556, 558 act as a stop to prevent the covering from being further slid onto the respective member 508, 510. Covering 554 further includes slits 560, 562 that are configured to be aligned with slits 518, 522 of second member 510 when the covering 554 is disposed on second member 510. It is to be appreciated that corresponding slits are on the opposite side of the covering 554 but not shown. In this manner when covering 554 is disposed over member 510, securing member 504, e.g., a strap, may be disposed through slit 560 and slit 518 to pass through the covering 554 and member 510 to enable the securing member 504 to secure a portion of the device 500 to a user, e.g., over the shoulder of the user. Similarly, securing member 506, e.g., a strap, may be disposed through slit 562 and slit 522 to pass through the covering 554 and member 510 to enable the securing member 506 to secure a portion of the device 500 to a user, e.g., a torso of the user.

Figure 10B:
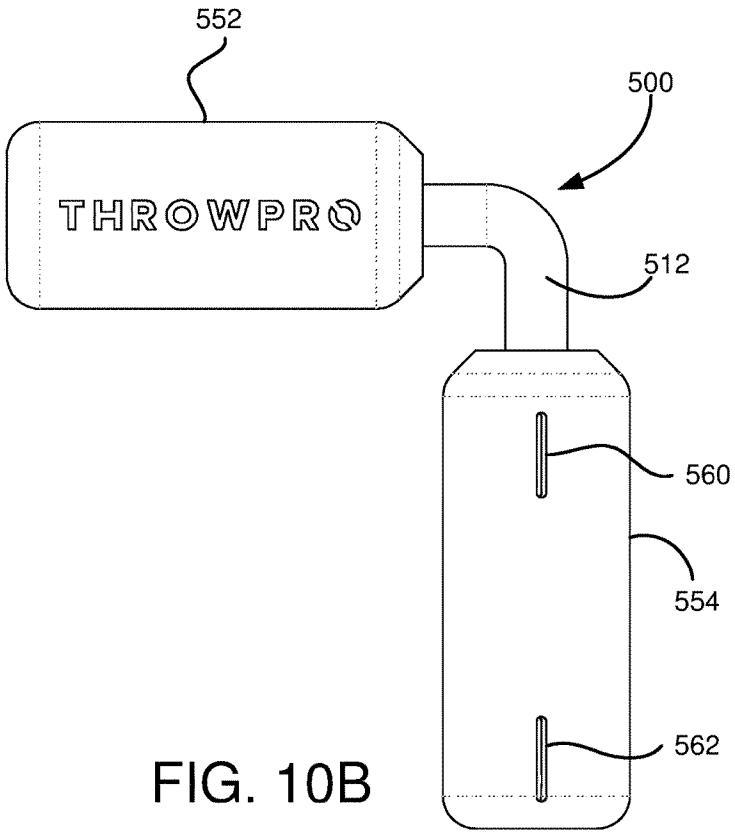
FIGS. 10A and 10B illustrate a throwing training device in accordance with a fifth embodiment of the present disclosure.
Figure 10A:
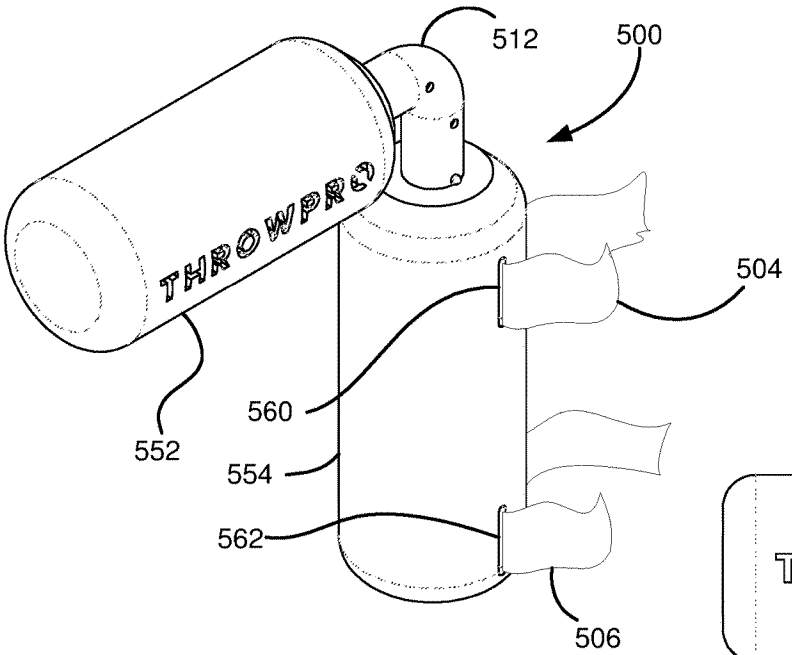
Figure 10C:
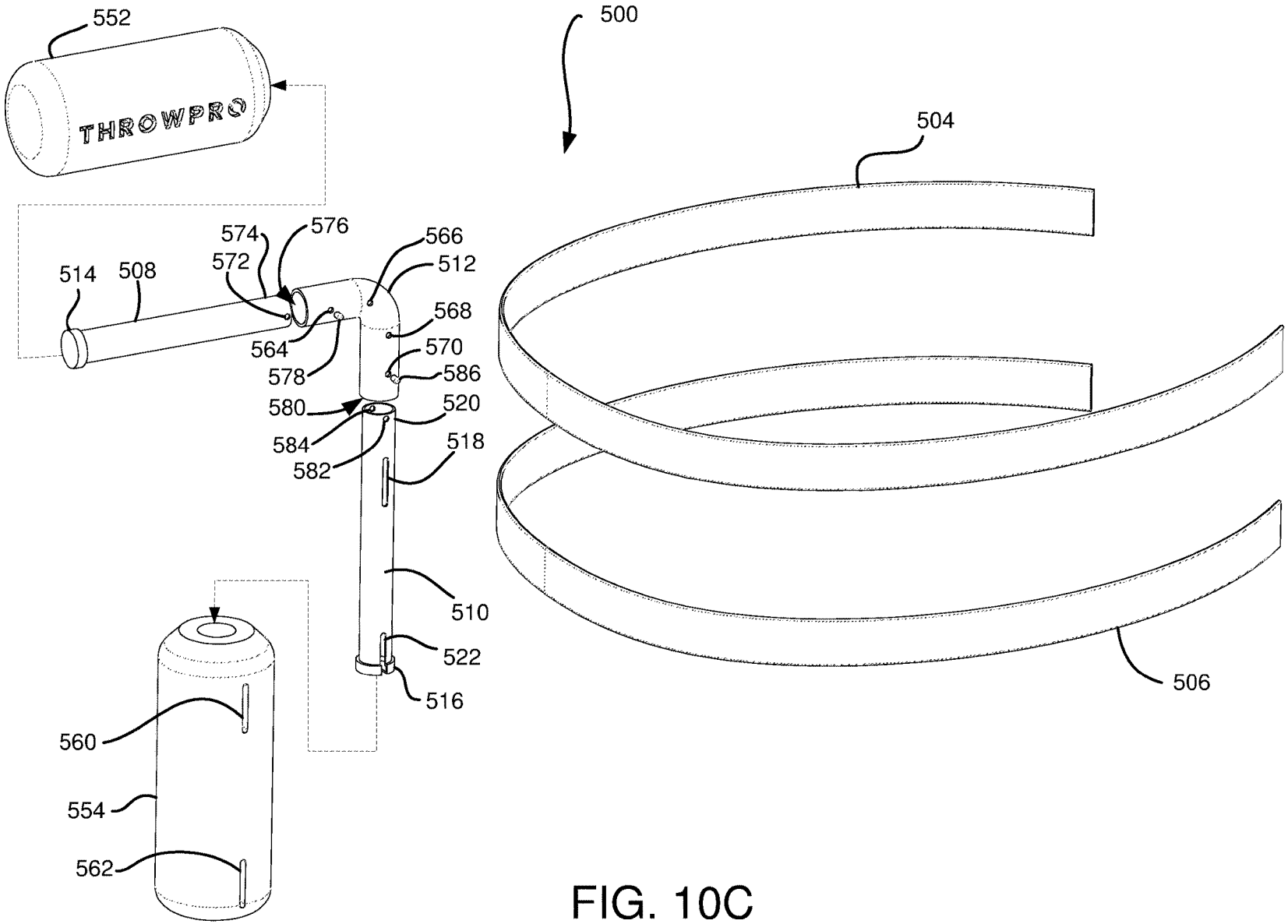
FIG. 10C is an exploded view of the throwing training device shown in FIG. 10A.
Figure 10E:
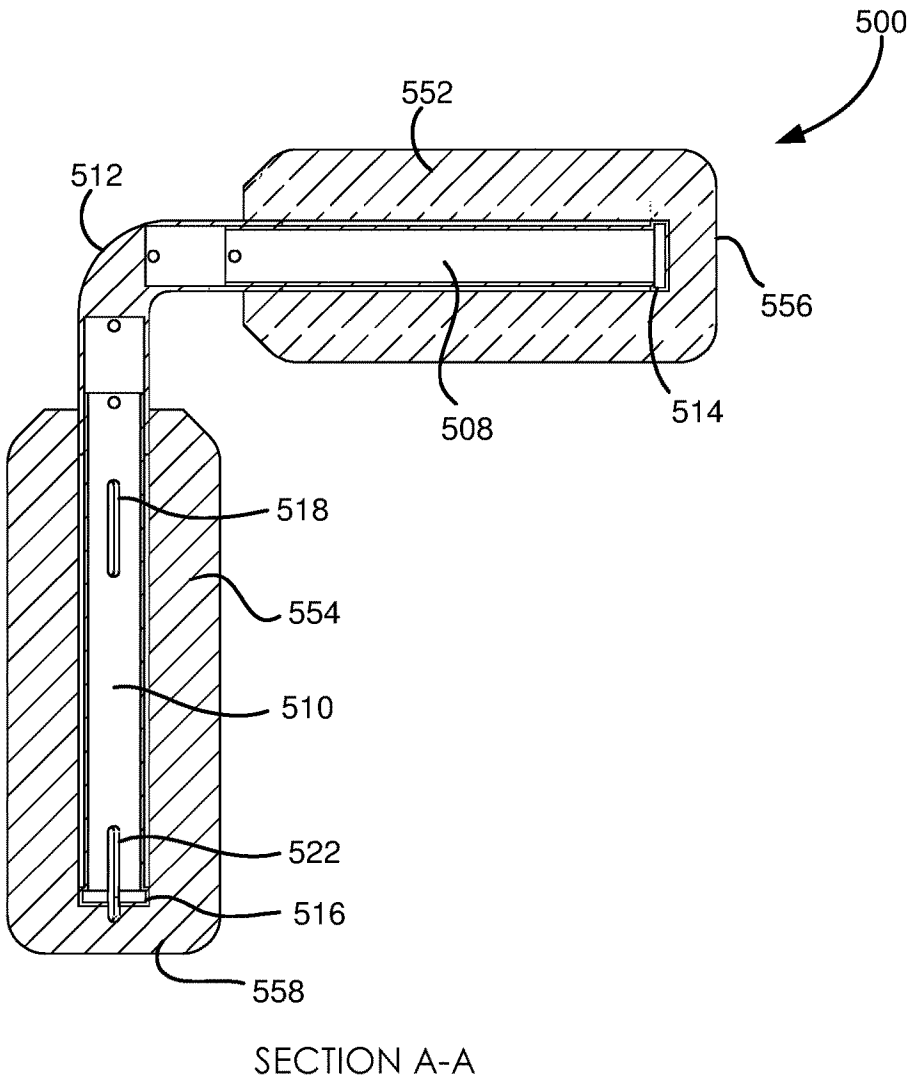
FIG. 10E is a cross sectional view of the throwing training device shown in FIG. 10D taken along line A-A.
Figure 10D:
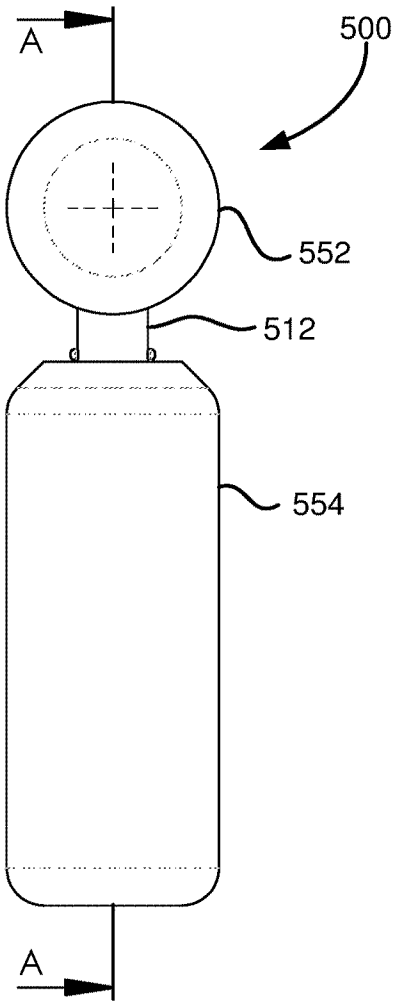
FIG. 10D is a front view of the throwing training device shown in FIG. 10A.

In one embodiment, the first member 508 and second member 510 may be adjustable relative to the elbow 512 to accommodate users of differing heights. As shown in FIG. 10C, elbow 512 includes a plurality of apertures 564, 566, 568, 570; it is to be appreciated that for each aperture there is a corresponding aperture (not shown) on the opposite side of the elbow 512. First member 508 includes aperture 572;

it is to be appreciated that there is a corresponding aperture (not shown) on the opposite side of the member 508. End 572 of first member 508 is disposed in channel 576 of elbow 518 until aperture 527 aligns with either aperture 564 or aperture 566 depending on the desired length. Once aligned, a lock pin 578 is disposed through aperture 564 and aperture 572 to lock first member 508 to elbow 512. Second member 510 includes apertures 582, 584. End 520 of second member 510 is disposed in channel 580 of elbow 518 until apertures 582, 584 aligns with either aperture 570 or aperture 568 depending on the desired length. Once aligned, a lock pin 586 is disposed through aperture 570 or aperture 568 and apertures 582, 584 to lock second member 510 to elbow 512.

It is to be appreciated that other means and methods may be used to couple first member 508 and second member 510 to elbow 512. For example, instead of employing a lock pin, a spring-loaded member may be disposed in aperture 572 that when end 574 of first member 508 is disposed in channel 576, the spring-loaded member may pop into aperture 564. When an adjustment is needed, the spring-loaded member is depressed and end 572 is further slid into the elbow 512 until spring-loaded member pops into aperture 566. A similar mechanism may be employed on the second member 510.

Figure 11A:
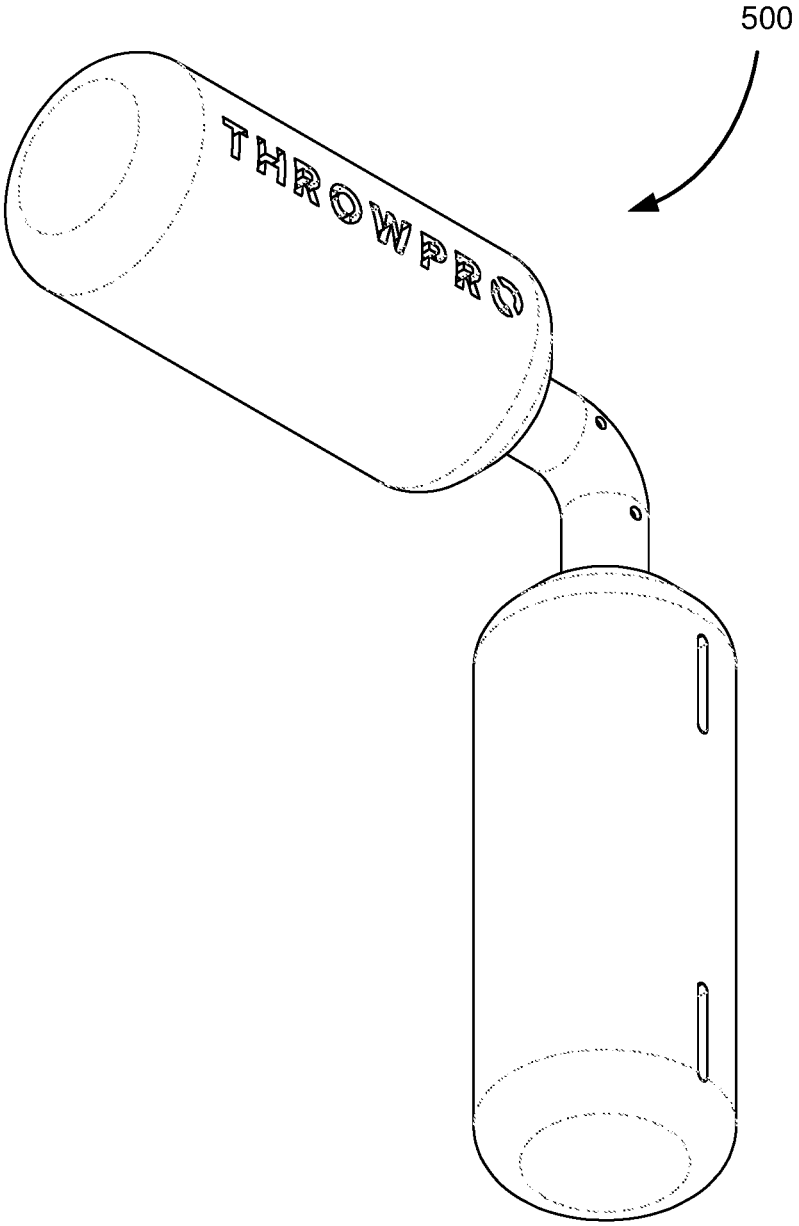
FIG. 11A is front, bottom, right perspective view of a throwing training device in accordance with an embodiment of the present disclosure.
Figure 11B:
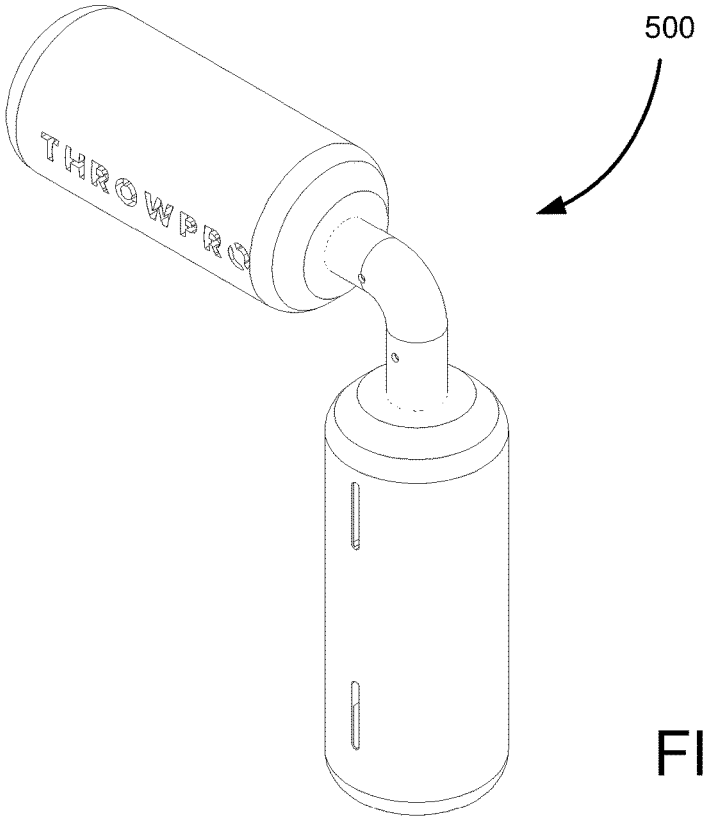
FIG. 11B is a rear, top, right perspective view of the throwing training device shown in FIG. 11A.
Figure 11C:
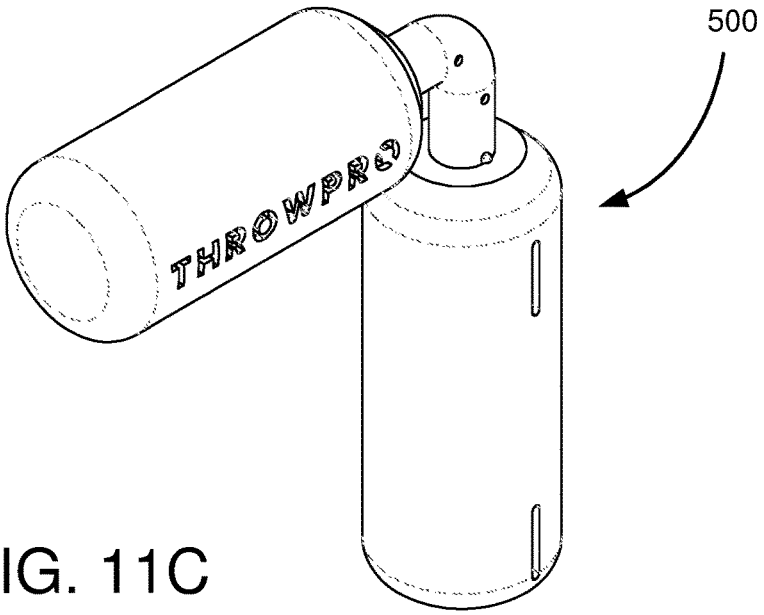
FIG. 11C is a is front, top, right perspective view of the throwing training device shown in FIG. 11A.
Figure 11D:
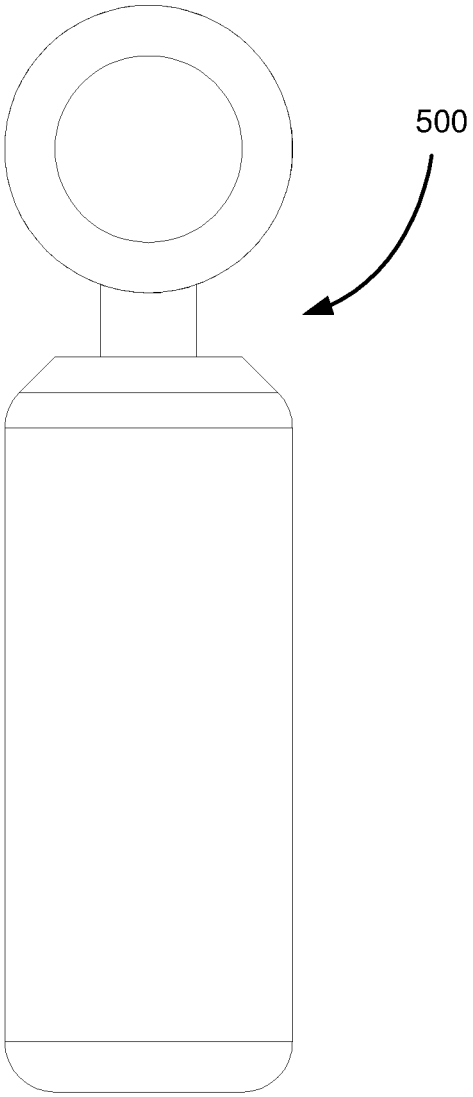
FIG. 11D is a front elevational view of the throwing training device shown in FIG. 11A.
Figure 11E:
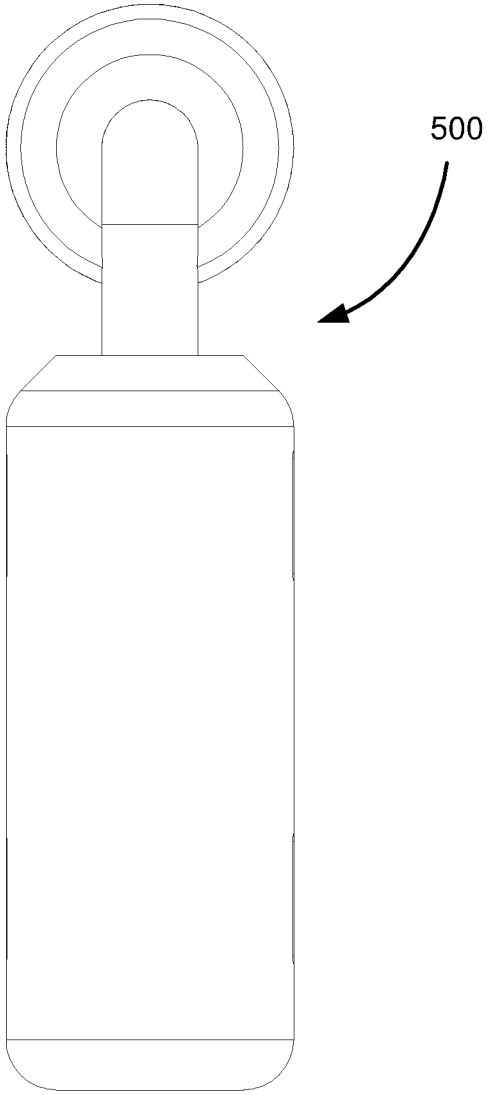
FIG. 11E is a rear elevational view of the throwing training device shown in FIG. 11A.
Figure 11F:
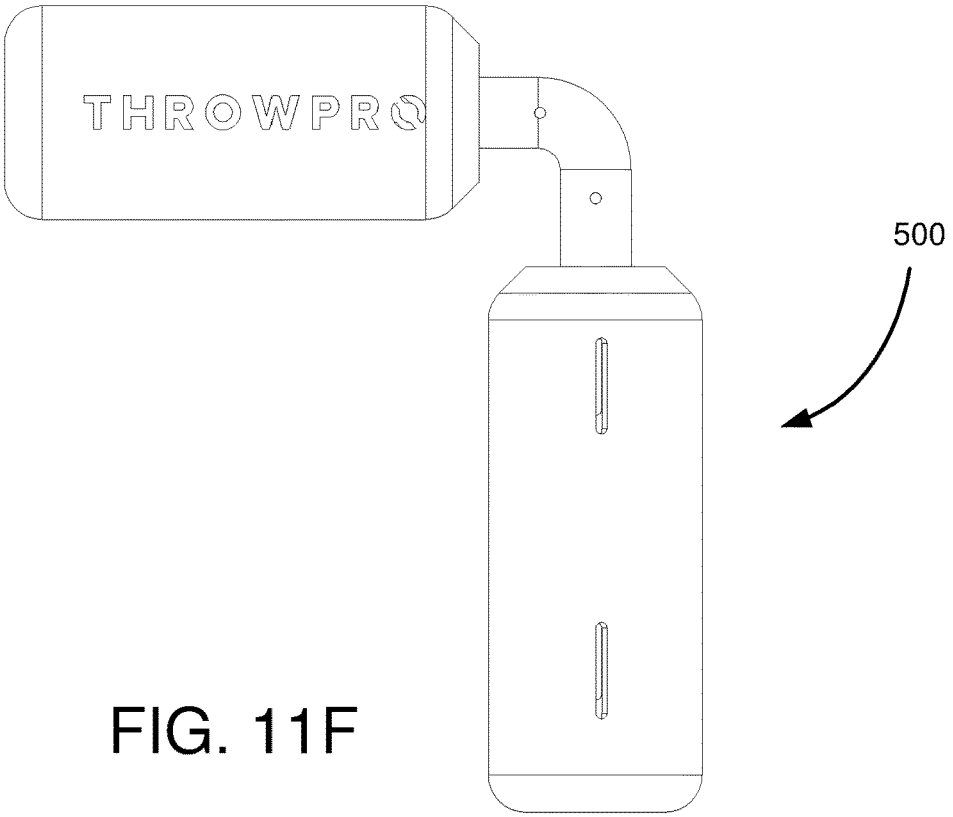
FIG. 11F is a right side elevational view of the throwing training device shown in FIG. 11A.
Figure 11G:
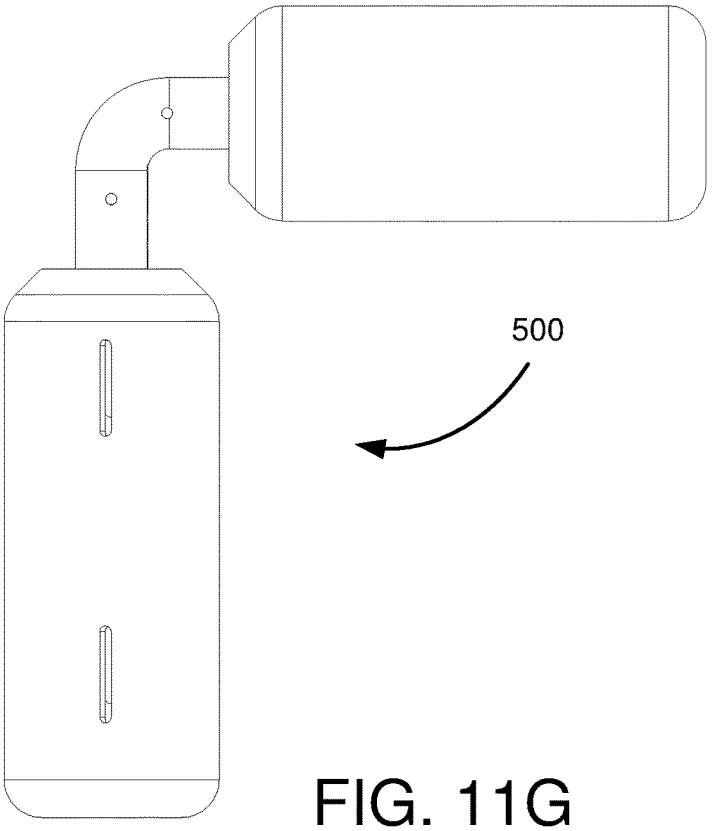
FIG. 11G is a left side elevational view of the throwing training device shown in FIG. 11A.
Figure 11H:
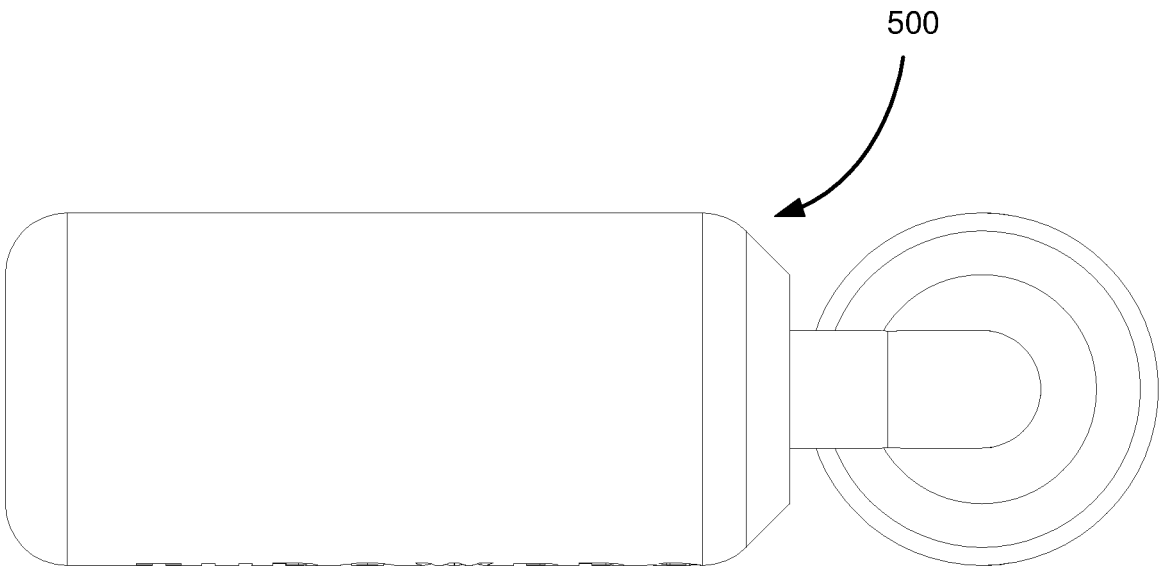
FIG. 11H is a top plan view of the throwing training device shown in FIG. 11A.
Figure 11I:
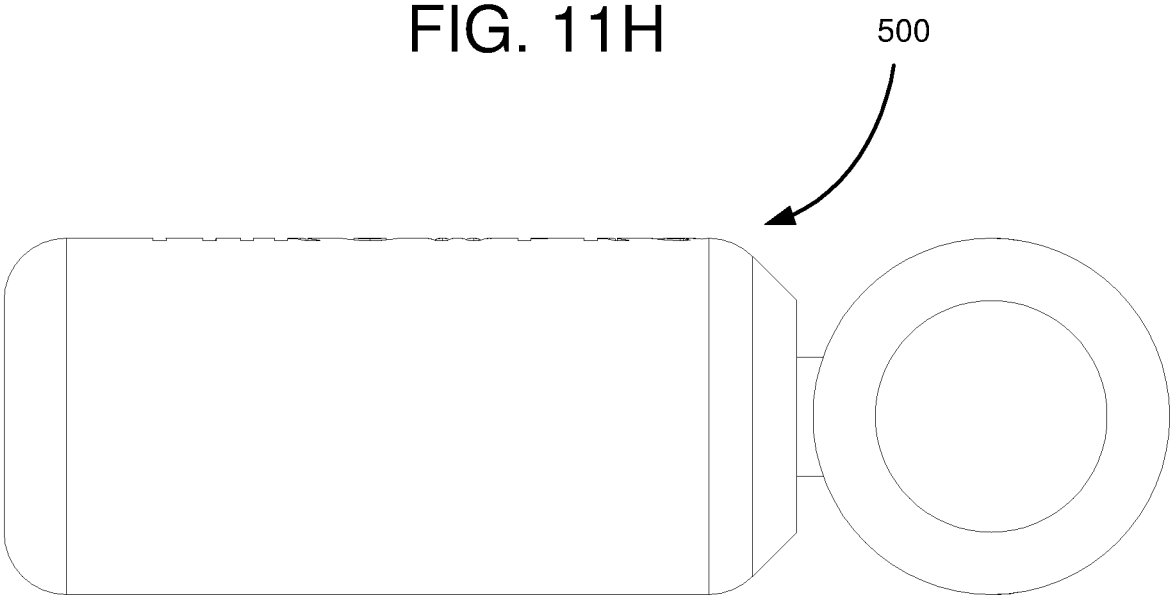
FIG. 11I is a bottom plan view of the throwing training device shown in FIG. 11A.

FIGS. 11A-11I illustrate various views of a training throwing device in accordance with an embodiment of the present disclosure, where FIG. 11A is front, bottom, right perspective view of a throwing training device, FIG. 11B is a rear, top, right perspective view of the throwing training device shown in FIG. 11A, FIG. 11C is a is front, top, right perspective view of the throwing training device shown in FIG. 11A, FIG. 11D is a front elevational view of the throwing training device shown in FIG. 11A, FIG. 11E is a rear elevational view of the throwing training device shown in FIG. 11A, FIG. 11F is a right side elevational view of the throwing training device shown in FIG. 11A, FIG. 11G is a left side elevational view of the throwing training device shown in FIG. 11A, FIG. 11H is a top plan view of the throwing training device shown in FIG. 11A, and FIG. 11I is a bottom plan view of the throwing training device shown in FIG. 11A.

Figure 12B:
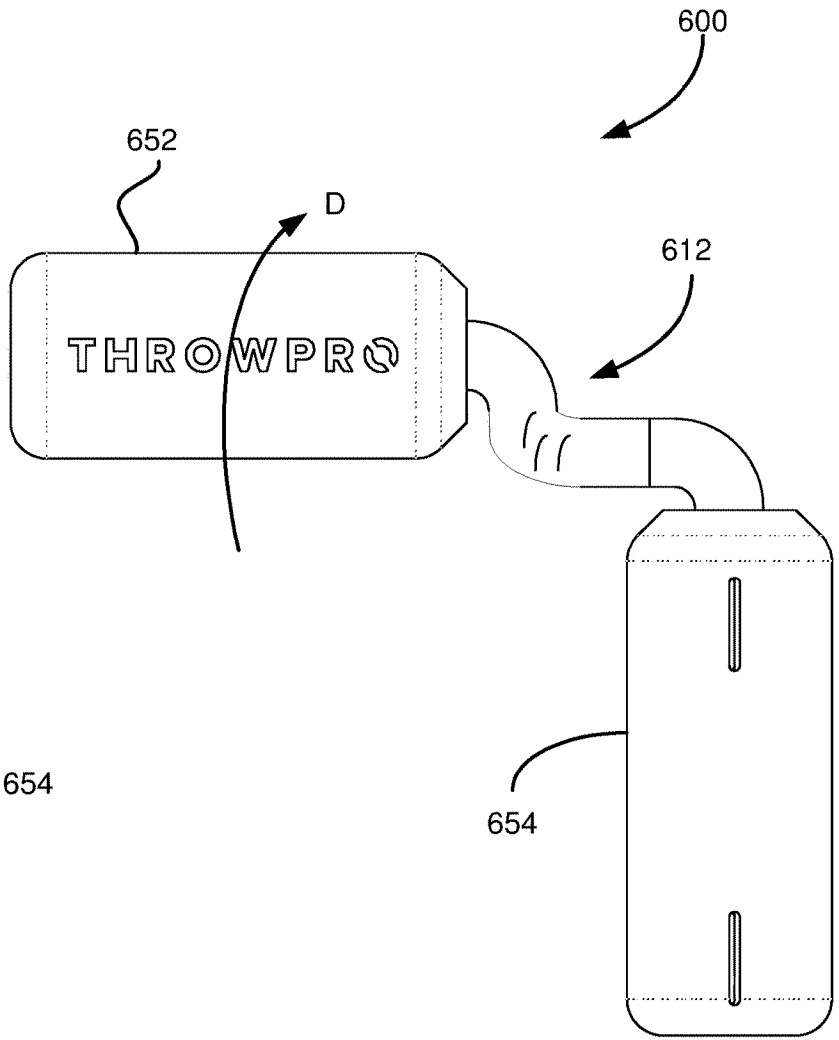
FIGS. 12A and 12B illustrate a throwing training device in accordance with a sixth embodiment of the present disclosure.
Figure 12A:
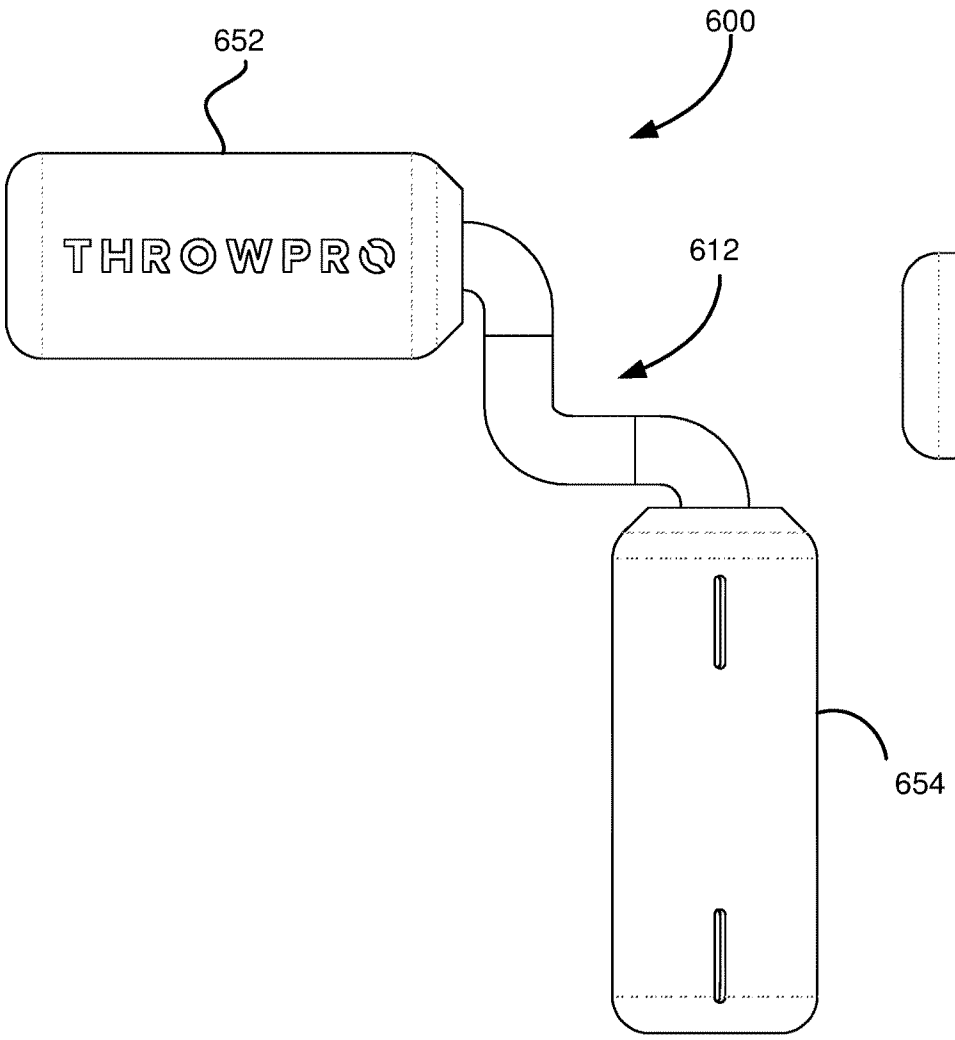
Figure 12C:
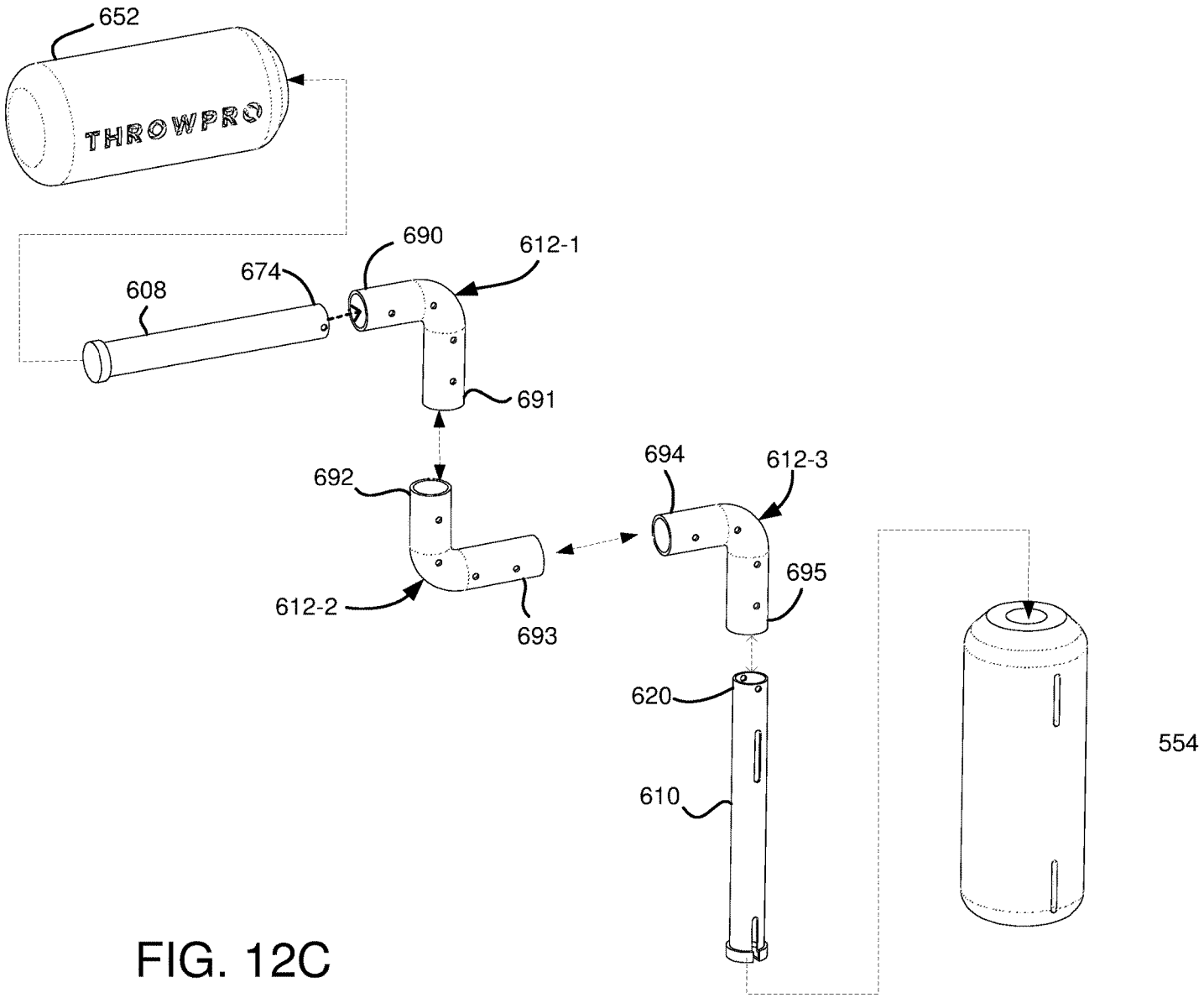
FIG. 12C is an exploded view of the throwing training device shown in FIG. 12A.

Referring to FIGS. 12A-12C, a throwing training device 600 in accordance with another embodiment of the present disclosure is provided. It is to be appreciated that device 600 is similar in some aspects to the above described embodiments, and those aspects will employ similar reference numerals but will not be described in detail for the sake of conciseness. Device 600 includes first pillow or covering 652 disposed over member 608 and second pillow or covering 654 disposed over second member 610. In this embodiment, the first member 608 is coupled to second member 610 by an elbow assembly 612, which is inverted relative to the other embodiments. The elbow assembly 612 includes first elbow 612-1, second elbow 612-2 and third elbow 612-3, wherein end 674 of member 608 is coupled to end 609 of elbow 612-1, end 691 of elbow 612-1 is coupled to end 692 of elbow 612-2, end 693 of elbow 612-2 is coupled to end 694 of elbow 612-3 and end 695 of elbow 612-3 is coupled to end 620 of member 610. In one embodiment, the various elbows 612-1, 612-2, 612-3 and members 608, 610 are rigidly coupled together, for example, by soldering, gluing, molding, welding, etc. In another embodiment, the various elbows 612-1, 612-2, 612-3 and members 608, 610 are coupled together as described in relation to device 500 with lock pins and/or spring-loaded members, as shown in FIG. 10C.

In a further embodiment, the various elbows 612-1, 612-2, 612-3 and members 608, 610 are rotatably coupled together, i.e., each elbow and/or member is rotatable relative to the elbow or member it is coupled to. For example, referring to FIG. 12B, when pillow or covering 652 is rotated in the direction of arrow D, end 693 of elbow 612-2 may rotate relative to end 694 of elbow 612-3. In this manner, the pillow 652 will be positioned in a lower position as compared to that shown in FIG. 12A, thereby making the pillow 652 or member 608 adjustable after pillow 654 or member 610 is coupled to a user. It is to be appreciated that the first, second and third elbow members are rotatably coupled to each other such that a distance of the first linear member to the second linear member is adjustable to compensate for a height of the user.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure as defined by the appended claims.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A training device comprising:

a first linear member coupled to a second linear member at a predetermined angle by an elbow member;

the second linear member including two securing members that secures the second member to a side of a torso of a user such that the second linear member is parallel to a torso of the user and the first linear member is parallel to a plane formed by the shoulders of the user, wherein a first of the two securing members is configured to be disposed over an opposite shoulder of the side of the torso of the user and a second of the two securing members is configured to be disposed around the torso of the user, wherein the first linear member provides tactile feedback to the user upon the user attempting a throwing motion.

2. The training device of claim 1, wherein the predetermined angle is approximately 90 degrees.

3. The training device of claim 1, wherein the predetermined angle is adjustable.

4. The training device of claim 1, wherein the elbow member is a pivoting joint.

5. The training device of claim 1, wherein the second linear member includes a concave surface to conform to a portion of the torso of the user.

6. The training device of claim 1, wherein the at least two securing members are straps.

7. The training device of claim 6, wherein the second linear member includes at least two pairs of slits, each pair of slits configured to receive at least one strap.

8. The training device of claim 7, further comprising a first pillow member configured to be disposed over the first linear member and a second pillow member configured to be disposed over the second linear member, the second pillow member including at least two pairs of slits corresponding to the at least two pairs of slits of the second linear member.

9. The training device of claim 1, further comprising a first pillow member configured to be disposed over the first linear member and a second pillow member configured to be disposed over the second linear member.

10. The training device of claim 1, wherein the elbow member includes a first channel that receives an end of the first linear member and a second channel that receives the second linear member, each channel includes at least one aperture that receives a lock pin for securing the respective first and second linear member.

11. The training device of claim 1, wherein the elbow member includes a first channel that receives an end of the first linear member and a second channel that receives the second linear member, each channel includes at least one aperture that receives a spring-loaded member disposed on a respective first and second linear member for securing the respective first and second linear member.

12. The training device of claim 1, wherein the elbow member is inverted.

13. The training device of claim 1, wherein the elbow member includes a first elbow coupled to a second elbow, the second elbow coupled to a third elbow.

14. The training device of claim 13, wherein the first, second and third elbow members are rotatably coupled to each other such that a distance of the first linear member to the second linear member is adjustable.

15. A method for training proper throwing motion comprising:

providing a training device including a first linear member coupled to a second linear member at a predetermined angle by an elbow member, the second linear member including at least two securing members that secures the second member to a user;

coupling the training device to a user by placing a corner of the elbow member under an armpit of the user and securing the second linear member to a torso of the user via the at least two securing members such that the second linear member is parallel to a torso of the user and the first linear member is parallel to a plane formed by the shoulders of the user; and instructing the user to initiate a throwing motion, wherein the training device provides feedback of an improper throwing motion if an elbow of the user makes contact with the first linear member.

16. The method of claim 15, further comprising adjusting a distance of the first linear member relative to the second linear member to compensate for the height of the user.

17. A training device comprising:

a first linear member coupled to a second linear member at a predetermined angle by an elbow member;

the second linear member including at least two securing members that secures the second member to a user such that the second linear member is parallel to a torso of the user and the first linear member is parallel to a plane formed by the shoulders of the user, the second linear member includes at least two pairs of slits, each pair of slits configured to receive one of the at least two securing members, wherein the first linear member provides tactile feedback to the user upon the user attempting a throwing motion; and a first pillow member disposed over the first linear member and a second pillow member disposed over the second linear member, the second pillow member including at least two pairs of slits corresponding to the at least two pairs of slits of the second linear member.

18. The training device of claim 17, wherein the elbow member includes a first channel that receives an end of the first linear member and a second channel that receives the second linear member, each channel includes at least one aperture that receives a lock pin for securing the respective first and second linear member.

19. The training device of claim 17, wherein the elbow member includes a first channel that receives an end of the first linear member and a second channel that receives the second linear member, each channel includes at least one aperture that receives a spring-loaded member disposed on a respective first and second linear member for securing the respective first and second linear member.

* * * * *